US005894275A

United States Patent [19]

Swingle

[11] Patent Number: 5,894,275

[45] Date of Patent: Apr. 13, 1999

[54] VOICE RECORDER/PLAYBACK MODULE

[75] Inventor: Charles E. Swingle, Murrieta, Calif.

[73] Assignee: Headway, Inc., Murrieta, Calif.

[21] Appl. No.: 09/053,474

[22] Filed: Apr. 1, 1998

[51] Int. Cl.[6] ..... G08B 25/08

[52] U.S. Cl. ..... 340/692; 340/573.3; 340/573.4; 340/600; 340/693.5; 340/693.9

[58] Field of Search ..... 340/692, 600, 340/573.1, 573.3, 573.4, 693.5, 693.9

[56] References Cited

U.S. PATENT DOCUMENTS

| | | | |
|---|---|---|---|
| 3,088,996 | 5/1963 | Carter | 369/70 |
| 3,509,288 | 4/1970 | Leventhal | 340/692 X |
| 4,617,556 | 10/1986 | Rivera et al. | 340/693 X |
| 4,791,741 | 12/1988 | Kondo | 40/124.1 |
| 4,801,929 | 1/1989 | Instance | 340/692 |
| 4,984,098 | 1/1991 | Buntsis | 340/692 X |
| 5,032,716 | 7/1991 | Lam et al. | 250/221 |
| 5,485,139 | 1/1996 | Tarnovsky | 340/573 |

*Primary Examiner*—Thomas Mullen
*Attorney, Agent, or Firm*—Loyal McKinley Hanson

[57] ABSTRACT

A record/playback module includes a case and an electronic circuit supported by the case for recording an audio message under control of a user and thereafter automatically playing the audio message in response to a change in ambient light. The electronic circuit has a RECORD mode of operation in which the electronic circuit records the audio message and a PLAY mode of operation in which the electronic circuit plays the audio message. The electronic circuit includes a first switch for initiating the RECORD mode of operation and a light sensitive subcircuit for initiating the PLAY mode of operation. The light sensing subcircuit is adapted to initiate the PLAY mode of operation when a second switch is in a first switch position and the ambient light increases, and when the second switch is in a second switch position and the ambient light decreases. One embodiment includes a battery power supply, an on-off switch, a light emitting diode indicating the RECORD mode of operation, and a case having a size and shape suitable for placement in a user's refrigerator with a reminder message that plays when the refrigerator door opens.

7 Claims, 2 Drawing Sheets

VOICE RECORDER/PLAYBACK MODULE

BACKGROUND OF THE INVENTION

1. Technical Field

This invention relates generally to devices for recording and playing voice messages, and more particularly to a voice recorder/playback module with improved design features and functionality.

2. Description of Related Art

Instructional messages guide many aspects of our daily personal lives. We find them used for education, behavior modification, child rearing, pet training, safety warnings, friendly reminders, and the like. Message repetition often increases message effectiveness, and so voice recorder/playback units are sometimes used to facilitate message repetition. But existing recorder/playback units often lack the design features and functionality needed to record a customized message and play it back when required for many diverse personal applications. Thus, many users share a need for an improved recorder/playback unit.

SUMMARY OF THE INVENTION

This invention addresses the problems outlined above by providing a small, battery powered, voice recorder/playback module that records a short-duration audio message under user control and thereafter automatically plays the audio in response to a change in ambient light. A mode switch allows the user to select whether the module plays back the audio (i) when the ambient light increases, or (ii) when the light decreases. Thus, the module can be activated by opening a refrigerator, cabinet, or purse where it is kept, as an example of increasing light, or it can be activated by the shadow of a passing child or pet (decreasing light).

To paraphrase some of the more precise language appearing in the claims, a record/playback module constructed according to the invention includes a case and an electronic circuit supported by the case. The electronic circuit records an audio message under control of a user and thereafter automatically plays the audio message in response to a change in ambient light. The electronic circuit has a RECORD mode of operation in which the electronic circuit records the audio message, and it has a PLAY mode of operation in which the electronic circuit plays the audio message.

The electronic circuit includes a first or record switch for initiating the RECORD mode of operation, and a light sensitive subcircuit for initiating the PLAY mode of operation. The light sensing subcircuit is adapted to initiate the PLAY mode of operation in two different modes referred to as playback actuation modes. In the first playback actuation mode, it initiates the PLAY mode of operation when a second or mode switch is in a first switch position and the ambient light increases. In the second playback actuation mode, it initiates the PLAY mode when the mode switch is in a second switch position and the ambient light decreases.

One embodiment includes an integrated circuit voice recorder/playback device with a battery power supply, an on-off switch, a light emitting diode indicating the RECORD mode of operation, and a case having a size and shape suitable for placement in a user's refrigerator with a reminder message that plays when the refrigerator door opens. The following illustrative drawings and detailed description make the foregoing and other objects, features, and advantages of the invention more apparent.

DESCRIPTION OF THE PREFERRED EMBODIMENTS

Figure 2:
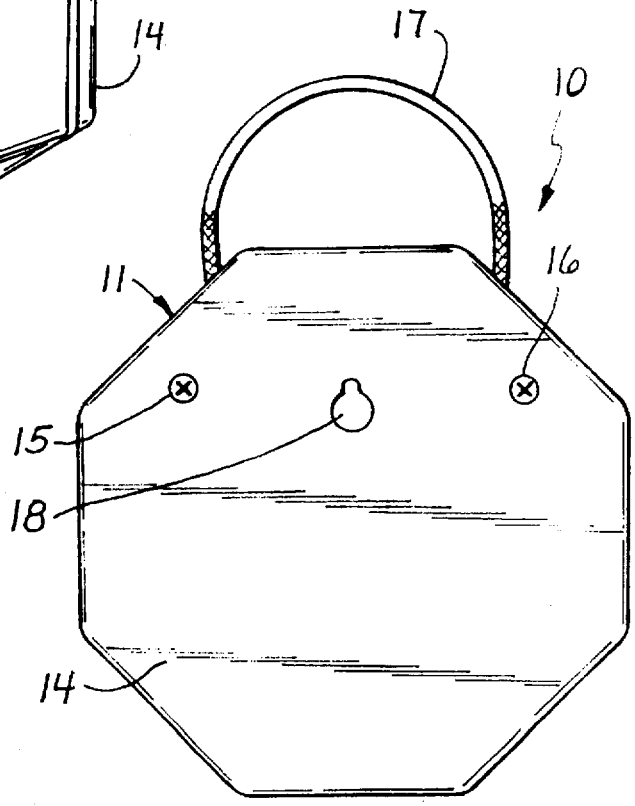
FIG. 2 is a back view of the module.
Figure 3:
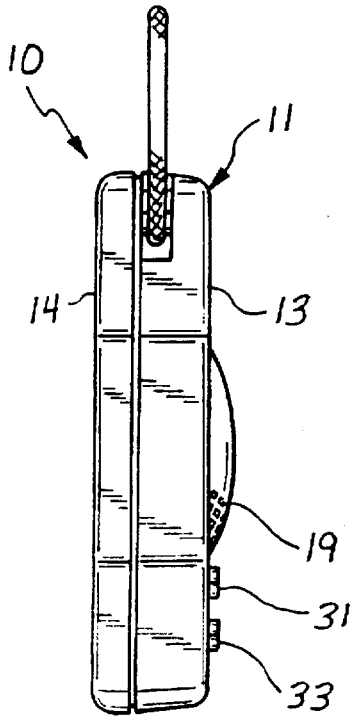
FIG. 3 is a left side view of the module.

The drawings show various details of a record/playback module 10 constructed according to the invention. Generally, the module 10 includes a case 11 (FIGS. 1–3) and an electronic circuit 12 (FIG. 4) in the case 11. Together, those components provide a device that records audio under control of a user and thereafter automatically plays the audio in response to changing ambient light.

The case 11 includes a front component 13 and a back component 14 that assemble together with screws 15 and 16 to enclose the electronic circuit 12 on a circuitboard (not shown) within the case 11. The case 11 is molded from plastic or other suitable material in a small, compact-size configuration so that it can be easily transported by hand and placed in a convenient location (e.g., in a refrigerator, medicine cabinet, or purse). Although any of various sizes and shapes may be employed, the illustrated case 11 has an octagonal shape measuring about 3.5 inches between opposite sides of the octagon and about 0.75 inch thick. A loop 17 of flexible material is secured to the case 11 for use in hanging the case 11 on a selected support structure, and a nail hole 18 is provided in the back component 14 for use in hanging the case 11 on a nail. A user can employ other mounting means instead of the loop 17 or the nail hole 18, including, for example, attaching a double-back adhesive strip (not shown) to the back component 14.

Figure 4:
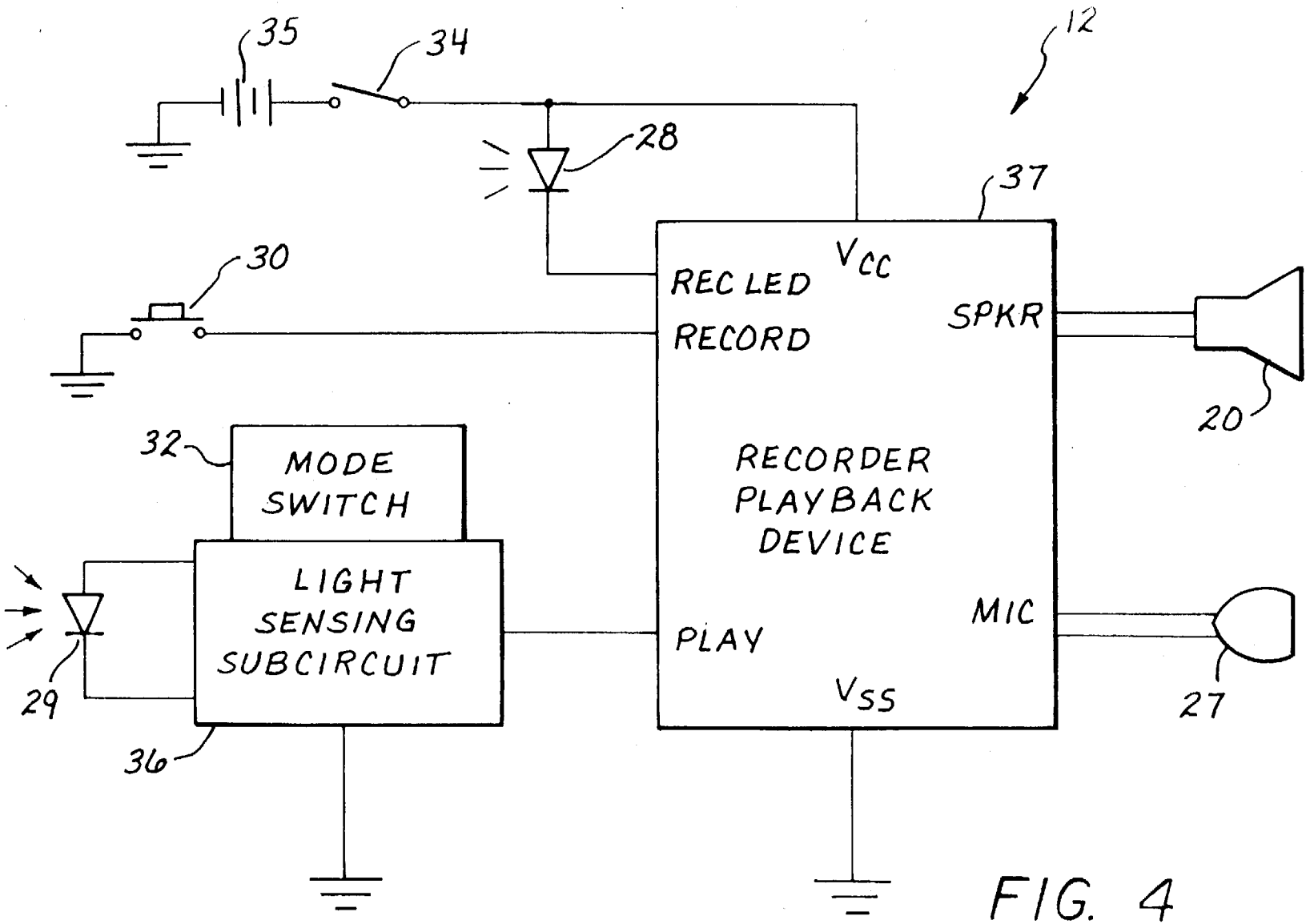
FIG. 4 is a block circuit diagram of the circuit in the module.

An array 19 of apertures through the front component 11 (FIGS. 1 and 3) serve as a speaker grill for a speaker 20 (FIG. 4) that is part of the circuit 12 within the case 11. Six openings 21 through 26 (FIG. 1) through the front component 11 provide access for other components of the circuit 12. The first opening 21 (FIG. 1) provides access from the exterior of the case 11 to a microphone 27 within the case 11 (FIG. 4), the second opening 22 (FIG. 1) provides access to a light emitting diode 28 (FIG. 4), and the third opening 23 provides access to a light sensitive resistor 29. The fourth opening 24 provides access to a pushbutton type of first switch actuator (not shown) of a first or record switch 30 (FIG. 4), the fifth opening 25 provides access to a slide type of second switch actuator 31 (FIGS. 1 and 2) of a second or mode switch 32 (FIG. 4), and the sixth opening 26 provides access to a slide type of third switch actuator 33 (FIGS. 1 and 3), of a third or on-off switch 34 (FIG. 4).

The preceding details of construction make the module 10 convenient to transport and use. To operate the module 10, the user slides the third switch actuator 33 of the on-off switch 34 toward the second switch actuator 31, from the OFF position illustrated in FIG. 1 to an ON position. Doing so connects a battery 35 (FIG. 4) to the other components of the circuit 12 to thereby turn on the circuit 12. The circuit 12 then assumes a STANDBY mode of operation in which it does nothing other than await initiation of a RECORD mode of operation or a PLAY mode of operation.

Next, the user depresses the pushbutton type of first switch actuator of the record switch 30 by accessing it through the opening 24 with the tip of a pencil, paper clip, fingernail file, or other suitably small object. Doing so initiates the RECORD mode of operation of the electronic circuit 12 for as long as the first switch actuator remains depressed up to a predetermined maximum duration (e.g., 20 seconds). It also turns on the light emitting diode 28 during the RECORD mode of operation so that the light emitting diode 28 is visible to the user.

With the electronic circuit 12 in the RECORD mode, the user speaks in the vicinity of the opening 21. Doing so inputs that audio to the electronic circuit via the microphone 27 so that the circuit 12 records the audio. It records the audio in the sense that it records sufficient information about the audio according to known sampling techniques to reproduce the audio in the PLAY mode of operation. Then, after inputting the desired audio, the user releases the first switch actuator and that results in the circuit 12 resuming the STANDBY mode of operation as the light emitting diode 28 turns off.

Having recorded the audio, the user selects a desired one of first and second playback actuation modes. In the first playback actuation mode, a light sensing subcircuit 36 that includes the light sensitive resistor 29 (FIG. 4) initiates the PLAY mode of operation of the circuit 12 when ambient light falling on the light sensitive resistor 29 increases. In the second playback actuation mode, the light sensing subcircuit 36 initiates the PLAY mode when ambient light falling on the light sensitive resistor 29 decreases. When the PLAY mode is initiated in either case, the circuit 12 plays back the audio previously recorded and then resumes the STANDBY mode of operation.

The user slides the second switch actuator 31 of the mode switch 32 to select the desired playback actuation mode, thereby switching the mode switch 32 to a corresponding one of first and second switch positions. The first switch position of the mode switch 32 results in the light sensing circuit 36 operating in the first playback actuation mode (playback initiated by increasing light). The second switch position of the mode switch 32 results in the light sensing circuit 36 operating in the second playback actuation mode (playback initiated by decreasing light).

Figure 1:
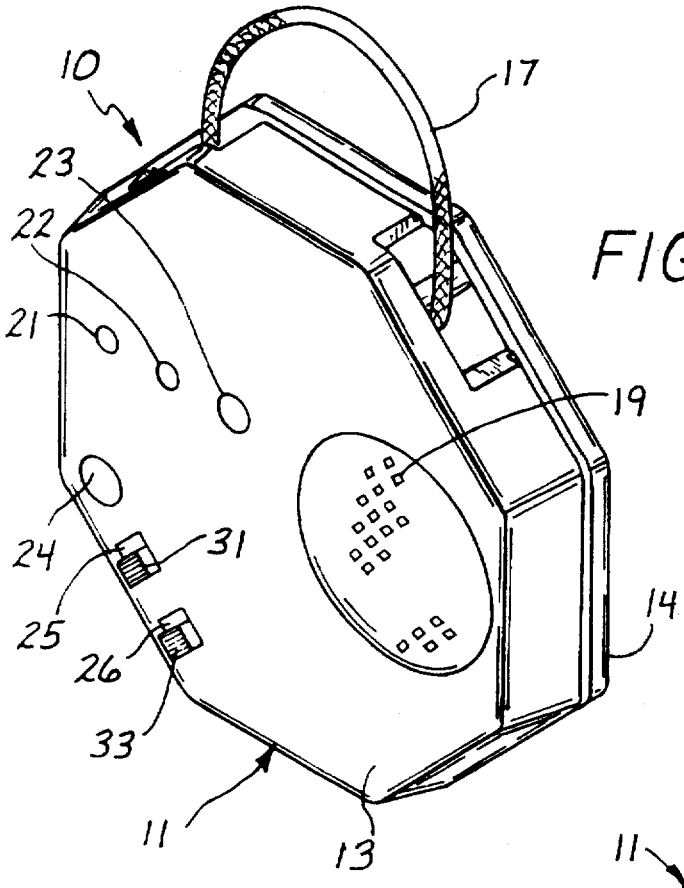
FIG. 1 of the drawings is a perspective view of a record/playback module constructed according to the invention.

The second switch actuator 31 is shown disposed all the way toward the opening 26 in FIG. 1. With the second switch actuator 31 so disposed, the mode switch 32 is in the second switch position. Moving the second switch actuator 31 all the way toward the opening 24 switches the mode switch 32 to the first switch position.

With the audio recorded and the playback actuation mode selected, the user places the module 10 in a desired location for automatic playback of the recorded audio. Selecting the first playback mode, for example, and placing the module 10 in the refrigerator results in the audio playing automatically whenever the refrigerator door is opened. Selecting the second playback mode, as another example, and placing the module 10 near a pet's food bowl results in the audio playing whenever the pet casts a shadow over the module 10.

Based upon the preceding description, one of ordinary skill in the art can readily construct a suitable electronic circuit using known design techniques and components. But further details of the circuit 12 illustrated in FIG. 4 provide an example. The circuit 12 employs a commercially available, single-chip, integrated circuit, voice record/playback device 37 manufactured by Information Storage Devices, Inc. of San Jose, Calif. The device 37 is interconnected to the other circuit components as indicated in FIG. 4 to form the circuit 12. Various other supporting components are also connected to the device 37 according to the product data sheet for the device 37 that is available from the manufacturer of the device 37, but they are not shown in FIG. 4 for illustrative convenience in order to keep FIG. 4 relatively uncluttered.

Thus, the invention provides a small, battery powered, voice recorder/playback module that records a short-duration audio message under user control and thereafter automatically plays the audio in response to a change in ambient light. A mode switch allows the user to select whether the module plays back the audio (i) when the ambient light increases, or (ii) when the light decreases so that the module has the functionality needed to record a customized message and play it back when required for many diverse personal applications. Although an exemplary embodiment has been shown and described, one of ordinary skill in the art may make many changes, modifications, and substitutions without necessarily departing from the spirit and scope of the invention.

What is claimed is:

1. A device, comprising:

a case; and means in the form of an electronic circuit supported by the case for recording an audio message under control of a user and thereafter automatically playing the audio message in response to a change in ambient light;

the electronic circuit having a RECORD mode of operation in which the electronic circuit records the audio message and a PLAY mode of operation in which the electronic circuit plays the audio message;

the electronic circuit including means in the form of a first switch for initiating the RECORD mode of operation and means in the form of a light sensitive subcircuit for initiating the PLAY mode of operation;

the light sensing subcircuit including a second switch having a first switch position and a second switch position;

the light sensing subcircuit being adapted to initiate the PLAY mode of operation when the second switch is in the first switch position and the ambient light increases; and the light sensing subcircuit being adapted to initiate the PLAY mode of operation when the second switch is in the second switch position and the ambient light decreases.

2. A device as recited in claim 1, wherein the light sensing subcircuit includes a light sensitive resistor that decreases in resistance as the ambient light increases.

3. A device as recited in claim 1, wherein the electronic circuit includes a light emitting diode adapted to emit light when the electronic circuit is in the RECORD mode of operation.

4. A device as recited in claim 1, wherein the electronic circuit includes a battery power supply.

5. A device as recited in claim 1, wherein the electronic circuit includes a third switch adapted to turn power to the electronic circuit on and off under control of the user.

6. A device as recited in claim 1, wherein the case is less than four inches in overall width, less than four inches in over all height, and less than one inch in overall thickness.

7. A device, comprising:

a molded plastic case adapted to be placed in a refrigerator; and means in the form of a battery powered electronic circuit supported and at least partially enclosed by the case for recording an audio message under control of a user before placing the device in the refrigerator and for thereafter automatically playing back the audio message in response to a change in ambient light occurring when the refrigerator door opens;

the electronic circuit including means in the form of a first switch for initiating a RECORD mode of operation and means in the form of a light sensitive subcircuit for initiating a PLAY mode of operation;

the light sensing subcircuit including a second switch having a first switch position and a second switch position;

the light sensing subcircuit being adapted to initiate the PLAY mode of operation when the second switch is in the first switch position and the ambient light increases so that opening the refrigerator door actuates the light sensing subcircuit; and the light sensing subcircuit being adapted to initiate the PLAY mode of operation when the second switch is in the second switch position and the ambient light decreases in order to enable use of the device in situations outside of the refrigerator where it is desired to initiate the PLAY mode when the ambient light decreases.

* * * * *